US007874298B2

(12) United States Patent
Malick

(10) Patent No.: US 7,874,298 B2
(45) Date of Patent: Jan. 25, 2011

(54) UNIT AND METHOD FOR DECORATING NAILS

(76) Inventor: Dina Suzanne Malick, 11 Chudleigh Way, Ruislip, Middlesex, HA4 8TS (GB)

( * ) Notice: Subject to any disclaimer, the term of this patent is extended or adjusted under 35 U.S.C. 154(b) by 508 days.

(21) Appl. No.: 11/955,813

(22) Filed: Dec. 13, 2007

(65) Prior Publication Data

US 2009/0151743 A1 Jun. 18, 2009

(51) Int. Cl.
*A45D 7/00* (2006.01)

(52) U.S. Cl. ..... 132/200

(58) Field of Classification Search ..... 132/73, 132/285, 319, 74.5, 75; 401/195; 101/327
See application file for complete search history.

(56) References Cited

U.S. PATENT DOCUMENTS

| | | | | |
|---|---|---|---|---|
| 2,783,711 | A * | 3/1957 | Vance | 101/333 |
| 3,898,357 | A | 8/1975 | Miller et al. | |
| 4,924,773 | A * | 5/1990 | Gwilliam | 101/327 |
| 5,269,330 | A | 12/1993 | Hayes | |
| 5,277,205 | A | 1/1994 | Jenkins | |
| 5,762,077 | A | 6/1998 | Griffiths, Jr. | |
| 5,890,494 | A | 4/1999 | Sonstegard | |
| 6,065,478 | A * | 5/2000 | Hartelius et al. | 132/73 |
| 6,626,183 | B1 | 9/2003 | Pietrocola et al. | |
| 2002/0023656 | A1 | 2/2002 | Chang | |
| 2004/0112397 | A1 | 6/2004 | Riester | |
| 2004/0159579 | A1 | 8/2004 | Winckels et al. | |
| 2004/0200496 | A1 * | 10/2004 | Choi | 132/200 |
| 2007/0125396 | A1 * | 6/2007 | Ramet | 132/73.5 |

FOREIGN PATENT DOCUMENTS

| | | | |
|---|---|---|---|
| EP | 0875397 | A1 | 11/1998 |
| GB | 2005597 | A * | 4/1979 |
| GB | 2283418 | A | 5/1995 |
| GB | 2427135 | A | 12/2006 |
| JP | 2002-051829 | A | 2/2002 |
| WO | WO01/17390 | A1 | 3/2001 |
| WO | WO2005/011991 | A1 | 2/2005 |

OTHER PUBLICATIONS

GB0512016.7, Search Report, Sep. 20, 2005.

* cited by examiner

*Primary Examiner*—Robyn Doan
(74) *Attorney, Agent, or Firm*—Inskeep IP Group, Inc.

(57) ABSTRACT

A unit for decorating nails comprises a container 2 of nail varnish, a lid 4 for the container incorporating means for applying the nail varnish, at least one ink pad 8, and at least one stamp 6 being a decoration design for applying ink from the ink pad to a nail. The stamp is provided on an external surface of the lid.

8 Claims, 1 Drawing Sheet

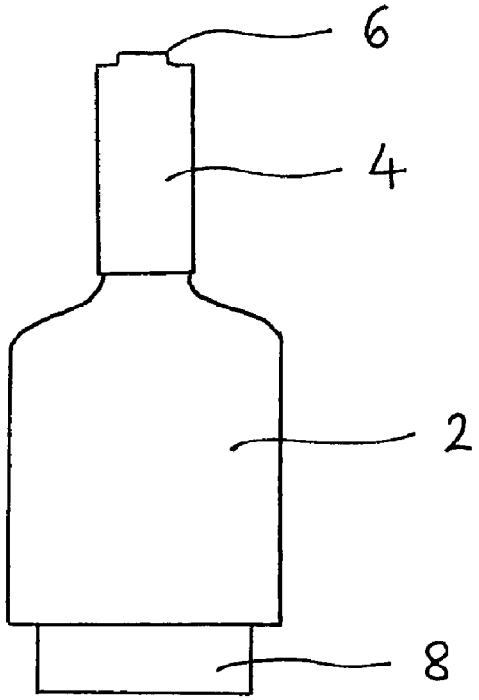
fig. 1
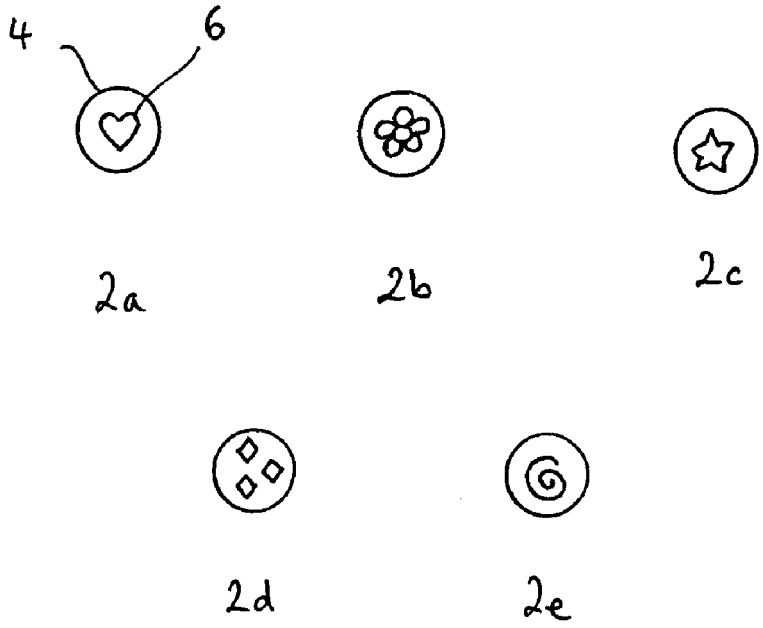
figs.

UNIT AND METHOD FOR DECORATING NAILS

BACKGROUND OF THE INVENTION

The present invention relates to a unit and method for decorating nails.

It is popular to decorate finger and toe nails using patterns and designs, in addition to the use of coloured nail varnish. Often these designs or patterns are applied at specialist saloons. Attendance at saloons is time consuming and expensive. Moreover, it is not particularly suitable for children.

OBJECTS AND SUMMARY OF THE INVENTION

The present invention seeks to provide a unit and method for decorating nails that is inexpensive to buy and simple to use. Consequently, it is suitable for use by children.

According to the present invention there is provided a unit for decorating nails comprising: a container of nail varnish; a lid for the container incorporating means for applying the varnish; at least one ink pad; and at least one stamp being a decorative design for applying ink from the ink pad to a nail; wherein the stamp is provided on an external surface of the lid.

Preferably, the stamp is provided on an exposed end of the lid. The stamp may be either raised or recessed with respect to the external surface of the lid.

In one embodiment, the ink pad is removably attached to the container. It may clip or screw on to the container. Preferably, the ink pad is provided on the base of the container.

Preferably, the nail varnish is clear. However, coloured nail varnish may also be used.

According to the present invention, there is also provided a method for decorating nails using the unit described above. This method comprises the following steps: (a) applying a layer of nail varnish from the container to a nail; (b) placing the stamp in the ink pad; (c) applying ink to the nail using the stamp; (d) applying a second layer of nail varnish from the container to the nail.

Preferably, in between steps (a) and (b), the ink pad is removed from the container.

The unit of the present invention is suitable for display on cosmetic counters or in cosmetic displays. A complete nail decorating system is provided in a single unit. This unit allows nails to be decorated easily and inexpensively.

BRIEF DESCRIPTION OF THE DRAWINGS

Embodiments of the present invention will now be described, by way of example only, with reference to the accompanying diagrammatic drawings, in which:

FIG. 1 is a front view of a unit of the present invention; and

FIGS. 2*a* to 2*e* are top plan views of the lid of the container of the unit, showing different stamp designs thereon.

DETAILED DESCRIPTION OF THE INVENTION

With reference to FIG. 1, a unit for decorating nails comprises a bottle of nail varnish 2. This varnish is clear, although coloured nail varnish may be used, whether transparent or opaque.

The bottle is provided with a generally cylindrical lid 4. Although the lid of the container is shown in the figures to be circular in cross-section, it could also be oval, triangular or rectangular in cross-section, for example. The lid is provided internally with a brush for applying the nail varnish to a nail in a traditional manner.

The top of the lid is provided with a stamp 6. As shown in FIGS. 2*a* to 2*e*, the stamp is a decorative design which may be in the form of a heart, flower, star, diamonds or spiral, for example. In the embodiments shown, the stamp is raised with respect to the top surface of the lid. Alternatively, it may be recessed into the top of the lid. The stamp is raised or recessed with respect to the top external surface of the lid by, for example, 2 to 10 mm, preferably 3 to 8 mm and more preferably about 4 to 6 mm. The raised or recessed profile of the stamp is designed, together with the ink pad, such that a positive or negative image of the stamp design (as appropriate) can be imprinted on a nail.

In a preferred embodiment, the stamp is integral with the lid. The lid and stamp may be moulded together from a plastics material. Alternatively, the stamp may be removable from the lid, in which case it should be dimensioned such that it can be readily manipulated by a user.

In the embodiments shown, an ink pad 8 is provided at the base of the container. The ink pad is removably attached to the base of the container. Alternatively, the ink pad is attached to the container but not removable therefrom, in which case the stamp is preferably removable from the lid.

The ink pad itself is enclosed in a container of some sort, such that the ink in the ink pad remains safely enclosed and it is not able to leak out or dry out. The container may be provided with means for accessing the ink pad therein, for example a lid or cap or flap.

The ink in the ink pad may be of any desirable colour. For example, it may be pink or silver or green, or be a mixture of colours. It may also include glitter.

To decorate nails using the unit of the present invention, a user removes the lid and applies a layer of nail varnish to a nail using the brush incorporated in the lid. Once the nail varnish has dried, ink from the ink pad is applied to the nail using the stamp. After allowing the ink to dry, a further layer of nail varnish is applied to the nail.

More specifically, in the embodiment shown, the lid of the bottle is replaced after applying the base coat of varnish, and the bottle is placed upside down. The ink pad is unclipped from the base of the bottle. The stamp is placed in the ink pad such that the design on the stamp is covered with ink. The stamp is placed on the nail to imprint the design on the nail. Once all nails have been imprinted, the ink pad is clipped back onto the base of the bottle.

In an alternative method, the ink pad remains attached to the bottle but has opening means to allow access to the ink pad. In this case, the stamp is removed from the lid of the bottle. Then, in a way similar to that described above, a base coat of nail varnish is applied to the nail; the removed stamp is placed in the ink pad which is still attached to the bottle; the stamp is used to imprint its design on the nail; finally, a top coat of nail varnish is applied.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A method for decorating nails using a unit comprising: a container of nail varnish; a lid for the container incorporating means for applying the varnish; at least one ink pad; and at least one stamp being a decorative design for applying ink from the ink pad to a nail; wherein the stamp is provided on an external surface of the lid; the method comprising the following steps:

(a) applying a layer of nail varnish from the container to a nail;

(b) placing the stamp in the ink pad;

(c) applying ink to the nail using the stamp;

(d) applying a second layer of nail varnish from the container to the nail.

2. A method as claimed in claim 1, wherein the stamp is provided on an exposed end of the lid.

3. A method as claimed in claim 1, wherein the stamp is either raised or recessed with respect to the external surface of the lid.

4. A method as claimed in claim 1, wherein the ink pad is removably attached to the container.

5. A method as claimed in claim 4, wherein the ink pad clips or screws onto the container.

6. A method as claimed in claim 1, wherein the ink pad is provided on the base of the container.

7. A method as claimed in claim 1, wherein the nail varnish is clear.

8. A method as claimed in claim 1, wherein, in between step (a) and step (b), the ink pad is removed from the container.

* * * * *